US006036790A

United States Patent [19]

Takada et al.

[11] Patent Number: 6,036,790

[45] Date of Patent: Mar. 14, 2000

[54] NON-TEMPERED STEEL FOR MECHANICAL STRUCTURE

[75] Inventors: Hiromasa Takada; Tetsuro Hashiguchi; Hideo Kanisawa, all of Muroran, Japan

[73] Assignee: Nippon Steel Corporation, Tokyo, Japan

[21] Appl. No.: 09/230,403

[22] PCT Filed: May 26, 1998

[86] PCT No.: PCT/JP98/02306

§ 371 Date: Jan. 25, 1999

§ 102(e) Date: Jan. 25, 1999

[87] PCT Pub. No.: WO98/54372

PCT Pub. Date: Dec. 3, 1998

[30] Foreign Application Priority Data

May 26, 1997 [JP] Japan ..... 9-149950

[51] Int. Cl.[7] ..... C22C 38/12; C22C 38/60

[52] U.S. Cl. ..... 148/320; 420/127; 420/84

[58] Field of Search ..... 148/320; 420/127, 420/84

[56] References Cited

U.S. PATENT DOCUMENTS

| | | | |
|---|---|---|---|
| 5,403,410 | 4/1995 | Shikanai | 420/127 |
| 5,922,145 | 7/1999 | Watari et al. | 148/320 |

FOREIGN PATENT DOCUMENTS

| | | |
|---|---|---|
| 7-3386 | 1/1995 | Japan . |
| 7-157824 | 6/1995 | Japan . |
| 9-53142 | 2/1997 | Japan . |
| 9-194999 | 7/1997 | Japan . |

*Primary Examiner*—Deborah Yee
*Attorney, Agent, or Firm*—Kenyon & Kenyon

[57] ABSTRACT

The medium carbon, microalloyed forging steel for machine structural use has a small deformation upon fracture in a hot-rolled, hot-forged, or any other hot-worked state, has an inexpensive ferrite-pearlitic microstructure and consists of C: 0.3 to 0.6 wt %, Si: 0.1 to 2.0 wt %, Mn: 0.1 wt % or more and less than 0.4 wt %, P: 0.01 to 0.1 wt %, S: 0.01 to 0.2 wt %, V: more than 0.15 wt % and up to 0.4 wt %, and the balance: Fe and unavoidable impurities, in which the unavoidable impurities include less than 0.005 wt % N. The microalloyed forging steel for machine structural use may further contain Al: 0.005 to 0.05 wt %, one or both of Ti: 0.005 to 0.05 wt % and Nb: 0.05 to 0.2 wt %, and/or one or both of Cr: 0.1 to 0.5 wt % and Mo: 0.1 to 0.5 wt %.

5 Claims, 1 Drawing Sheet

NON-TEMPERED STEEL FOR MECHANICAL STRUCTURE

TECHNICAL FIELD

The present invention relates to a microalloyed forging steel for machine structural use having a small deformation of a fracture surface when fracture-split and is generally applicable to steel blanks for machine structural use and machine parts which require a small deformation upon tensile and impact fracture.

BACKGROUND ART

The steels for machine structures, which are used to form parts of automobiles and industrial machinery, are usually supplied in the form of a straight bar or a coiled wire and are hot- or cold-worked to a desired shape, followed by various heat treatments, machining, etc., to provide a final part. When the processing from steel blanks to parts includes fracture-separation by cold tension, it is usually necessary to control the deformation upon fracture in order to ensure the required precision in the subsequent working step or to prevent occurrence of troubles in an automated working line.

Usual steel parts were conventionally formed by hot or cold forging, followed by quench-hardening and tempering to provide required strength and toughness. These days, microalloyed steels for hot forging (hereinafter simply referred to as "microalloyed forging steel"), which have the required strength in an as-forged state, are increasingly used. Replacing the quench-hardened and tempered steel with the microalloyed forging steel is advantageous because omission of heat treatment lowers the production cost and eliminates quenching distortion.

The forming method of microalloyed forging steel parts includes fracture-splitting by impact tension, working of required portions and then recoupling the fracture surfaces and is practically used typically for forming a connecting rod made, for example, of a steel having a relatively high carbon content such as Fe-0.72%C-0.22%Si-0.49%Mn0.062%S-0.04%V as described in "Fundamentals and Applications of Microalloying Forging Steels", (1996) 29 TMS.

The process of producing a connecting rod can be roughly summarized as hot-forging of a steel blank followed by air cooling, boring and drilling of a cap and a rod, mechanical splitting of a large end, recoupling of the fracture surfaces, bolting of the cap and the rod, and finish-machining.

This process is advantageous because relatively inexpensive steel blanks can be used and conventionally required high precision machining can also be omitted to reduce costs. However, the above-recited steel contains a large amount of carbon to enhance fracturability, and therefore, has a problem of low yield strength and fatigue strength as well as poor machinability.

Japanese Unexamined Patent Publication (Kokai) No. 8-291373 discloses a steel, for connecting rods, in which the carbon content is reduced from the above-recited steel while fracturability is ensured, and describes that the disclosed microalloyed steel for hot forging is "easy to fracture-separate and the fractured surface has a small deformation and is easily recoupled".

Japanese Unexamined Patent Publication (Kokai) No. 9-3589 discloses a low toughness microalloyed forging steel for connecting rods and describes that an increased N amount, in particular, provides a brittle fracture surface upon fracture-splitting and "the object is to provide a high strength, low toughness microalloyed forging steel which exhibits a flat, brittle fracture surface when fracture-split at room temperature".

However, the steels disclosed in Japanese Unexamined Patent Publication (Kokai) No. 8-291373 or Japanese Unexamined Patent Publication (Kokai) No. 9-3589 failed to provide a commercially acceptable fracturability.

DISCLOSURE OF THE INVENTION

The object of the present invention is to provide an inexpensive, medium carbon microalloyed forging steel for machine structural use having a small deformation when fractured in the state of as hot-worked by hot rolling, hot forging, etc. and being composed of a ferrite-pearlitic microstructure.

To reduce the deformation of a steel upon fracture, it is most effective to reduce the ductility of the steel. Several measures are able to reduce the ductility by adjusting the chemical composition of steel. One is to increase the carbon content such as the 0.72% C steel described in the above-recited (1996) 29 TMS. However, steels having a ferrite-pearlitic microstructure have a lower yield ratio (yield strength/tensile strength) and a lower fatigue strength as the carbon content is increased. Another is to use a large amount of P to embrittle crystal grain boundaries but P also significantly reduces the ductility at high temperatures and makes difficult the casting, rolling and hot working of steel.

To provide an improved fracturability without the above problems, the present inventors conducted various studies and obtained the following novel findings.

1) Improvement of Fracturability

Mn acts as a solid solution strengthening element to strengthen a steel while causing no significant reduction in ductility due to the strengthening and the medium carbon (0.25% or more C) steels for machine structural use usually contain about 0.6% or more Mn. Based on this fact, the present inventors studied the relationship between Mn and fracturability and found that there is a strong correlation between the fracturability and the Mn content, particularly when the Mn content is reduced to less than 0.4%, the steel ductility is lowered and the deformation upon fracture is reduced. The reduced Mn content advantageously lowers the ductility while causing no significant reduction in the high temperature ductility, which is different from the addition of a large amount of P.

Microalloyed forging steels generally contain V or Nb as a precipitation strengthening element and, if these elements are bonded with N in steel to form nitrides, austenite grains are refined during heating for forging and the ferrite amount in the microstructure is also increased to increase the ductility, so that the reduction in Mn content alone cannot provide the practically required low ductility (high fracturability). Therefore, it is of primary importance to suppress precipitation of nitrides by reducing the N content. Some of microalloyed forging steels designed for improved toughness contain 0.01% or more N, and even otherwise, steels obtained by the usual steelmaking process usually contain 0.005% or more N. Japanese Unexamined Patent Publication (Kokai) No. 9-3589 recommends addition of N in as large an amount as possible. However, the present inventors conducted experiments using V added, 0.5% C microalloyed forging steels and found that the deformation in terms of the reduction of the fracture surface area is smaller for lower N contents such that a 0.004% N steel has a deformation of 70 taking that of a 0.01% N steel as 100.

2) Improvement of Yield Strength and Fatigue Strength

To provide a ferrite-pearlitic steel with improved yield ratio (yield strength/tensile strength) and fatigue limit ratio, it is effective to reduce the carbon content and increase amounts of suitable alloying elements. In V-strengthened microalloyed forging steels, simply reducing the carbon content from 0.7% to 0.6% improves the yield ratio from 0.55 to 0.65 and the fatigue limit ratio from 0.39 to 0.44. Thus, it is important to reduce the carbon content as long as the required fracturability is ensured. As is known in the art, improving the yield ratio and the fatigue limit ratio by the precipitation strengthening effect of V is also essential to make up for the strength reduction because of the reduced C and Mn contents.

Based on the above findings, the first, second, third and fourth inventions provide microalloyed forging steels for machine structural use as stated in (1), (2), (3) and (4) below.

(1) A microalloyed forging steel for machine structural use, characterized by consisting of:

C: 0.3 to 0.6 wt %,

Si: 0.1 to 2.0 wt %,

Mn: 0.1 wt % or more and less than 0.4 wt %,

P: 0.01 to 0.1 wt %,

S: 0.01 to 0.2 wt %,

V: more than 0.15 wt % and up to 0.4 wt %, and the balance: Fe and unavoidable impurities, in which the unavoidable impurities includes less than 0.005 wt % N and the steel has a ferrite-pearlitic microstructure.

(2) A microalloyed forging steel for machine structural use as stated in (1), characterized by further containing:

Al: 0.005 to 0.05 wt %.

(3) A microalloyed forging steel for machine structural use as stated in (1) or (2), characterized by further containing one or both of:

Ti: 0.005 to 0.05 wt %, and

Nb: 0.05 to 0.2 wt %.

(4) A microalloyed forging steel for machine structural use as stated in any one of (1) to (3), characterized by further containing one or both of:

Cr: 0.1 to 0.5 wt %, and

Mo: 0.1 to 0.5 wt %.

BEST MODE FOR CARRYING OUT THE INVENTION

Figure 1:
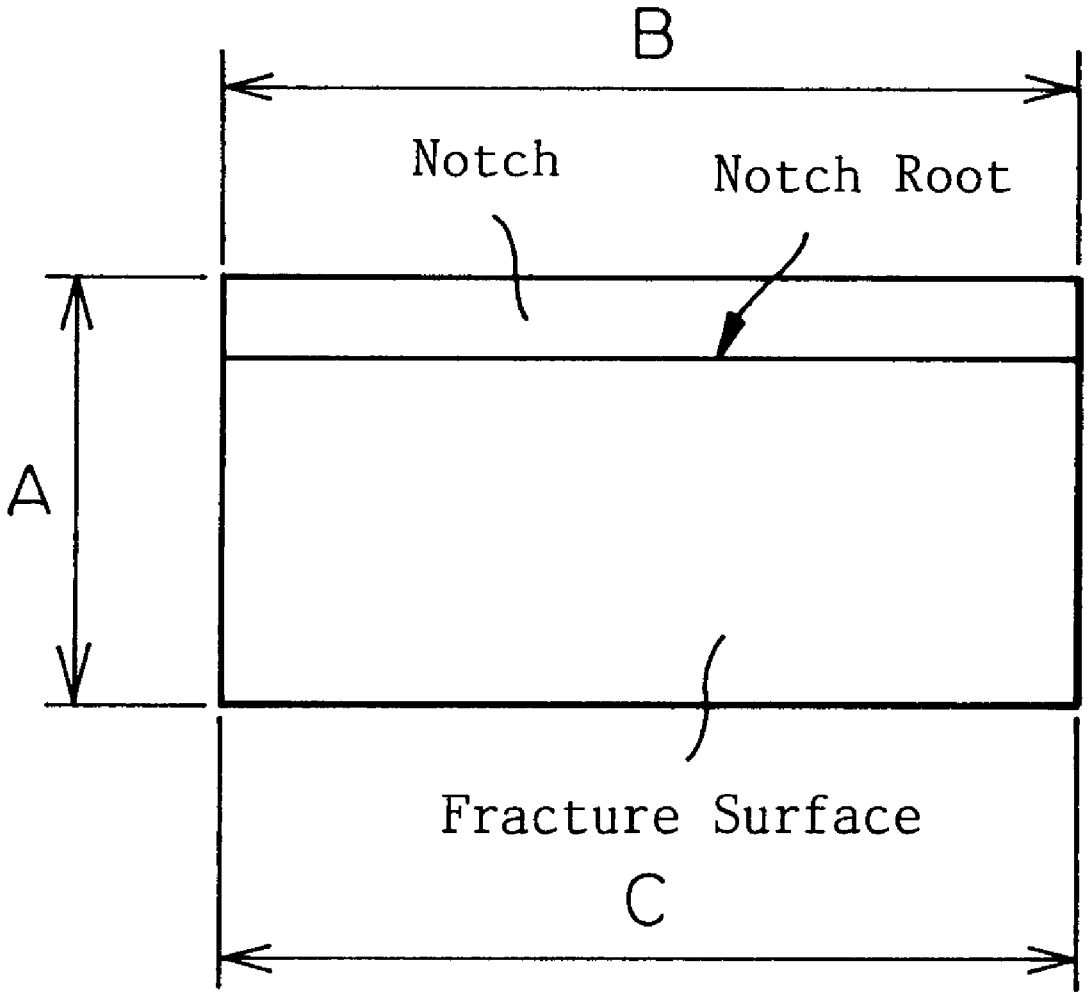
FIG. 1 is a plan view showing a fracture surface of a notched tensile test piece broken by tension (cross-section 10×20 mm, notch root 1.0R, notch depth 2.0 mm), in which A is a length perpendicular to the notch and B and C are lengths parallel to the notch.

According to the present invention, the chemical composition is specified for the following reasons.

C: 0.3 to 0.6%

0.3% or more C is necessary to provide a required strength of machine structural parts and an improved fracturability by embrittlement of the steel. However, an excessive C content lowers yield strength and fatigue strength, and therefore, the upper limit is 0.6%.

Si: 0.1 to 2.0%

Si acts as a solid solution strengthening element, also lowers the steel ductility and must be present in an amount of 0.1% or more to provide significant reduction in ductility. However, an amount more than 2.0% lowers the high temperature ductility to cause cracking to occur during rolling and forging and also promotes decarburization.

Mn: 0.1% to less than 0.4%

Mn is usually used as a solid solution strengthening element, and in the present invention, the Mn content is limited to less than 0.4% to lower the ductility. Mn also forms MnS to improve machinability. However, if the Mn content is less than 0.1%, S is brought into solid solution to embrittle crystal grain boundaries during heating and the hot ductility is lowered to cause frequent occurrence of cracking during production of steel blanks and steel parts.

P: 0.01 to 0.1%

P is segregated at crystal grain boundaries cause embrittlement of the steel, thereby improving the fracturability. To provide this effect, the P content must be 0.01% or more. However, an excessive P content lowers the hot ductility and causes cracking to easily occur, and therefore, the P content must not be more than 0.1%.

S: 0.01 to 0.2%

S is used to improve the machinability. The S amount must be 0.01% or more to improve the machinability and the upper limit is 0.2% to suppress development of anisotropy of the mechanical properties.

V: more than 0.15% to 0.4%

V mainly improves the yield strength and the fatigue strength by precipitation strengthening and also lowers the ductility. V must be present in an amount of more than 0.15% but a V amount of more than 0.4% only provides a small effect with respect to the required cost.

N: less than 0.005%

Reduction of the N content is very important to provide an improved fracturability. N forms VN and NbN to refine the microstructure of steel blanks and hot-worked products and also increases the ferrite amount to enhance the ductility, and therefore, the N amount is preferably as small as possible. To provide a practically required small deformation upon fracture, the N content must be less than 0.005%.

Al: 0.005 to 0.05%

Al acts as a deoxidizing agent. Usual forging steels are produced by using Al deoxidation, which unavoidably causes dispersion of alumina particles in the steel to occasionally lower the machinability. Therefore, when a very good machinability is required, Al deoxidation is not used (the first invention). The omission of Al deoxidation also advantageously ensures absence of the precipitation of AlN, so that the microstructure is coarsened to improve the fracturability.

However, when a target tensile strength is low, or when the machining amount is small, the machinability raises no significant problems and 0.0005% or more Al may be present, but an amount more than 0.05% provides no further effect (the second invention).

Ti: 0.005 to 0.05%

Ti is utilized as a precipitation strengthening element. If TiN is formed, the hot-forged microstructure is refined to enhance the ductility. However, a required low ductility is obtained if the N content is less than 0.005% and the steel has a sufficiently high hardness. To ensure precipitation strengthening, 0.005% or more Ti is necessary and the upper limit is less than 0.05% to prevent lowering of the machinability because of formation of coarse oxides.

Nb: 0.05 to 0.2%

Similarly to V, Nb provides precipitation strengthening to improve the yield strength and the fatigue strength and to lower the ductility. The presence of Nb together with V further improves the above effect. The Nb content must be 0.05% or more to effect strengthening but an Nb amount of more than 0.2% only provides a small effect with respect to the required cost.

Cr: 0.1 to 0.5%, Mo: 0.1 to 0.5%

Cr and Mo may be added in an amount of 0.1% or more, respectively, if necessary for adjustment of the strength, and the amount must not be more than 0.5% to prevent the fracturability from lowering because of refinement of a pearlitic microstructure.

It would cause no problem if, to improve the machinability, one or more of 0.01 to 0.4% Pb, 0.01 to 0.4% Bi, 0.01 to 0.04% Se, 0.002 to 0.005% Te and 0.0005 to 0.003% Ca are added in the present inventive steel.

Ferrite-pearlitic steels have a tensile strength and a hardness which are basically determined by the carbon equivalent Ceq. expressed by a formula such as Ceq.(%)=C%+(1/7)Si%+(1/5)Mn%+(1/2)V% described in Japanese Examined Patent Publication (Kokoku) No. 60-45250. As can be seen from this formula, the present inventive steel is inexpensive because it is a medium carbon steel and a desired tensile strength can be achieved by using small amounts of expensive elements other than carbon. The production cost is also substantially reduced by using the present inventive steel to produce steel parts by hot forging without subsequent heat treatment.

The present inventive steel is further characterized by having a ferrite-pearlitic microstructure, which requires no special steelmaking process or forging method but is achieved by a usual commercial steelmaking process including melting and casting and a usual hot rolling to a hot-rolled bar or a hot forging to form automobile parts, followed by free air cooling or fan-forced air cooling. It is a further advantage of the present inventive steel that it has a medium carbon, low Mn composition containing V facilitating ferritic transformation, and therefore, supercooled phases such as bainite hardly form in contrast to the conventional microalloyed steel for hot forging.

EXAMPLES

Steels having chemical compositions summarized in Table 1 were produced by using a 150 kg vacuum melting furnace, reheated at 1473 K, hot-forged to round bars having a diameter of 20 mm, and air-cooled to provide steel blanks. All of the samples had a ferrite-pearlitic microstructure. To measure the deformation upon fracture, notched tensile test pieces (cross-section: 10×20 mm, notch root radius: 1.0 R, notch depth: 2.0 mm) were machined from the steel blanks and were fractured by tension. Measurement of the fractured test pieces showed that all of the samples had substantially the same deformation on the fracture surface in the direction perpendicular to the notch (the change in the length of edge A shown in FIG. 1). The fracturability was evaluated ("deformation" in Table 1) in terms of the deformation on the fracture surface in the direction parallel to the notch, specifically the sum of the changes in width of the fracture surface on the notch side and on the smooth side (the changes in the lengths of edges B and C shown in FIG. 1). Unnotched tensile test pieces having a parallel portion diameter of 9 mm were also machined from the steel blanks and tested for tensile strength.

The thus-determined tensile strength and deformation are also summarized in Table 1. The present inventive steels had tensile strengths in a range of 708 MPa to 992 MPa and deformations of less than 0.40 while the conventional QT (quenched and tempered) steel (No. 1, quench-hardened from 850° C., tempered at 600° C.) and the conventional microalloyed forging steel (No. 2) had deformations of 0.56 to 0.65. Comparative steel No. 12 had a relatively small deformation. However, a further study showed that, because of a large carbon content, sample No. 12 had as small a yield ratio as 0.58 and was inferior to the present inventive sample Nos. 6 and 41 having relatively small yield ratios of 0.64 and 0.62 because they had the largest carbon contents among the present inventive samples. The comparative sample Nos. 19 and 21 contained large amounts of Al and had a poor machinability which was 20% lower than that of sample No. 15 in terms of VL1000 (the maximum circumferential speed at which drilling can be conducted for a total drilled length of 1000 mm) measured by using a cemented carbide drill.

INDUSTRIAL APPLICABILITY

As described hereinabove, the present inventive steel has a good strength and an extremely small deformation upon fracture as a machine structural steel having a ferrite-pearlitic microstructure for automobile and industrial machinery use, and moreover, is inexpensive. The present inventive steel is most advantageously applied in ferrite-pearlitic steel blanks and parts not requiring a good impact property but subject to fracture working.

TABLE 1

| No. | Note | C | Si | Mn | P | S | Cr | Mo | V | Nb | TN | Others | T.S. (MPa) | Deformation (mm) |
|---|---|---|---|---|---|---|---|---|---|---|---|---|---|---|
| 1 | Comparative QT steel | 0.55 | 0.23 | 0.72 | 0.012 | 0.020 | 0.02 | — | — | — | 0.0076 | — | 746 | 0.64 |
| 2 | Comparative micro-alloyed forging steel | 0.50 | 0.25 | 0.80 | 0.017 | 0.058 | 0.28 | — | 0.055 | — | 0.0082 | — | 788 | 0.56 |
| 3 | 1st invention | 0.55 | 0.41 | 0.24 | 0.024 | 0.014 | — | — | 0.153 | — | 0.0047 | — | 866 | 0.31 |
| 4 | 1st invention | 0.31 | 1.86 | 0.19 | 0.013 | 0.054 | — | — | 0.152 | — | 0.0022 | — | 708 | 0.38 |
| 5 | 1st invention | 0.43 | 0.80 | 0.22 | 0.022 | 0.055 | — | — | 0.200 | — | 0.0032 | — | 836 | 0.35 |
| 6 | 1st invention | 0.58 | 0.50 | 0.25 | 0.023 | 0.060 | — | — | 0.151 | — | 0.0028 | — | 894 | 0.39 |
| 7 | 1st invention | 0.52 | 0.11 | 0.34 | 0.023 | 0.085 | — | — | 0.177 | — | 0.0031 | — | 887 | 0.35 |
| 8 | 1st invention | 0.53 | 0.50 | 0.35 | 0.055 | 0.092 | — | — | 0.204 | — | 0.0020 | — | 947 | 0.32 |
| 9 | 1st invention | 0.45 | 1.33 | 0.22 | 0.094 | 0.053 | — | — | 0.204 | — | 0.0025 | — | 894 | 0.32 |
| 10 | 1st invention | 0.31 | 0.42 | 0.17 | 0.020 | 0.175 | — | — | 0.385 | — | 0.0035 | — | 955 | 0.30 |
| 11 | Comparative steel | 0.20 | 1.50 | 0.28 | 0.020 | 0.005 | — | — | 0.200 | — | 0.0034 | — | 691 | 0.40 |
| 12 | Comparative steel | 0.70 | 0.22 | 0.50 | 0.030 | 0.060 | — | — | 0.110 | — | 0.0034 | — | 979 | 0.38 |
| 13 | Comparative steel | 0.49 | 1.02 | 0.35 | 0.022 | 0.054 | — | — | 0.170 | — | 0.0090 | — | 887 | 0.49 |
| 14 | Comparative steel | 0.50 | 0.98 | 0.36 | 0.022 | 0.055 | — | — | 0.173 | — | 0.0146 | — | 895 | 0.52 |
| 15 | 2nd invention | 0.45 | 1.29 | 0.29 | 0.088 | 0.046 | — | — | 0.197 | — | 0.0021 | Al: 0.026 | 891 | 0.30 |

TABLE 1-continued

| No. | Note | C | Si | Mn | P | S | Cr | Mo | V | Nb | TN | Others | T.S. (MPa) | Deformation (mm) |
|---|---|---|---|---|---|---|---|---|---|---|---|---|---|---|
| 16 | 2nd invention | 0.53 | 0.44 | 0.37 | 0.062 | 0.085 | — | — | 0.198 | — | 0.0036 | Al: 0.047 | 926 | 0.32 |
| 17 | 3rd invention | 0.42 | 0.50 | 0.14 | 0.030 | 0.110 | — | — | 0.250 | — | 0.0035 | Ti: 0.014 | 860 | 0.36 |
| 18 | 3rd invention | 0.41 | 1.01 | 0.12 | 0.024 | 0.108 | — | — | 0.205 | — | 0.0029 | Ti: 0.045 | 823 | 0.38 |
| 19 | Comparative steel | 0.46 | 1.20 | 0.30 | 0.030 | 0.109 | — | — | 0.210 | — | 0.0026 | Al: 0.088 | 912 | 0.44 |
| 20 | Comparative steel | 0.47 | 1.05 | 0.22 | 0.028 | 0.121 | — | — | 0.201 | — | 0.0097 | Ti: 0.080 | 889 | 0.45 |
| 21 | Comparative steel | 0.43 | 0.44 | 0.22 | 0.024 | 0.111 | — | — | 0.200 | — | 0.0122 | Al: 0.067, Ti: 0.054 | 825 | 0.53 |
| 22 | 4th invention | 0.45 | 0.77 | 0.28 | 0.023 | 0.062 | 0.25 | — | 0.182 | — | 0.0022 | — | 867 | 0.33 |
| 23 | 4th invention | 0.47 | 0.74 | 0.24 | 0.025 | 0.060 | 0.47 | — | 0.182 | — | 0.0024 | — | 902 | 0.34 |
| 24 | 3rd invention | 0.49 | 0.73 | 0.26 | 0.024 | 0.062 | — | — | 0.160 | 0.07 | 0.0022 | — | 937 | 0.31 |
| 25 | 3rd invention | 0.31 | 0.20 | 0.20 | 0.025 | 0.059 | — | — | 0.155 | 0.18 | 0.0029 | — | 879 | 0.32 |
| 26 | 4th invention | 0.49 | 0.30 | 0.26 | 0.022 | 0.084 | — | 0.15 | 0.175 | — | 0.0034 | — | 902 | 0.32 |
| 27 | 3rd & 4th inventions | 0.40 | 0.33 | 0.28 | 0.022 | 0.080 | — | 0.48 | 0.170 | — | 0.0029 | — | 971 | 0.33 |
| 28 | 3rd & 4th inventions | 0.39 | 0.55 | 0.30 | 0.025 | 0.055 | 0.30 | — | 0.162 | 0.06 | 0.0019 | — | 872 | 0.37 |
| 29 | 3rd invention | 0.39 | 0.54 | 0.32 | 0.024 | 0.052 | 0.29 | 0.20 | 0.152 | — | 0.0021 | — | 860 | 0.39 |
| 30 | 3rd & 4th inventions | 0.43 | 0.55 | 0.30 | 0.025 | 0.051 | — | 0.27 | 0.168 | 0.05 | 0.0020 | — | 992 | 0.39 |
| 31 | 3rd & 4th inventions | 0.40 | 0.02 | 0.21 | 0.040 | 0.052 | 0.10 | 0.12 | 0.151 | 0.06 | 0.0027 | — | 641 | 0.35 |
| 32 | 2nd & 4th inventions | 0.35 | 0.65 | 0.27 | 0.032 | 0.021 | 0.20 | — | 0.160 | — | 0.0038 | Al: 0.015 | 749 | 0.38 |
| 33 | 2nd & 3rd & 4th inventions | 0.37 | 0.82 | 0.25 | 0.033 | 0.022 | 0.22 | 0.34 | 0.163 | — | 0.0032 | Al: 0.015, Ti: 0.010 | 918 | 0.37 |
| 34 | 3rd & 4th inventions | 0.36 | 0.84 | 0.25 | 0.030 | 0.019 | — | 0.20 | 0.164 | 0.07 | 0.0027 | Ti: 0.013 | 923 | 0.31 |
| 35 | Comparative steel | 0.33 | 0.20 | 0.24 | 0.025 | 0.066 | 1.02 | — | 0.155 | — | 0.0032 | — | 783 | 0.43 |
| 36 | Comparative steel | 0.35 | 0.11 | 0.38 | 0.032 | 0.060 | — | 0.90 | 0.157 | — | 0.0038 | — | 1106 | 0.47 |
| 37 | Comparative steel | 0.35 | 0.13 | 0.35 | 0.030 | 0.062 | — | — | 0.160 | 0.29 | 0.0070 | — | 1101 | 0.47 |
| 38 | 1st invention | 0.55 | 0.33 | 0.29 | 0.032 | 0.056 | — | — | 0.202 | — | 0.0034 | Pb: 0.10, Ca: 0.001 | 934 | 0.37 |
| 39 | 2nd invention | 0.49 | 0.51 | 0.20 | 0.024 | 0.123 | — | — | 0.199 | — | 0.0050 | Al: 0.029, Pb: 0.01, Ca: 0.0008 | 861 | 0.37 |
| 40 | 3rd invention | 0.45 | 0.16 | 0.17 | 0.054 | 0.055 | — | — | 0.150 | — | 0.0033 | Ti: 0.015, Bi: 0.05 | 751 | 0.37 |
| 41 | 3rd invention | 0.60 | 0.12 | 0.12 | 0.097 | 0.180 | 0.20 | — | 0.175 | — | 0.0020 | Te: 0.02 | 912 | 0.36 |

(Note)
Chemical compositions in wt %. "T.S." means tensile strength". "3rd & 4th inventions" etc. mean "combination of the third and fourth inventions" etc.

We claim:

1. A microalloyed forging steel for machine structural use, characterized by consisting of:

C : 0.3 to 0.6 wt %,

Si: 0.1 to 2.0 wt %,

Mn: 0.1 or more and less than 0.4 wt %, p : 0.01 to 0.1 wt %,

S : 0.01 to 0.2 wt %,

V : more than 0.15 wt % and up to 0.4 wt %, and the balance: Fe and unavoidable impurities, in which the unavoidable impurities include less than 0.005 wt % N and the steel has a ferrite-pearlite microstructure.

2. A microalloyed forging steel for machine structural use according to claim 1, characterized by further containing:

Al: 0.005 to 0.05 wt %.

3. A microalloyed forging steel for machine structural use according to claim 1 characterized by further containing one or both of:

Ti: 0.005 to 0.05 wt %, and

Nb: 0.05 to 0.2 wt %.

4. A microalloyed forging steel for machine structural use according to claim 1 characterized by further containing one or both of:

Cr: 0.1 to 0.5 wt %, and

Mo: 0.1 to 0.5 wt %.

5. A microalloyed forging steel for machine structural use according to claim 1 characterized by further comprising at least one of:

Pb: 0.01 to 0.4 wt %,

Bi: 0.01 to 0.4 wt %,

Se: 0.01 to 0.4 wt %,

Te: 0.002 to 0.005 wt %, and

Ca: 0.0005 to 0.003 wt %.

* * * * *